US010520261B2

(12) United States Patent
Brunner et al.

(10) Patent No.: US 10,520,261 B2
(45) Date of Patent: Dec. 31, 2019

(54) FLAT PIPE

(71) Applicant: MAHLE INTERNATIONAL GMBH, Stuttgart (DE)

(72) Inventors: Steffen Brunner, Weissach im Tal (DE); Achim Herber, Bietigheim-Bissingen (DE); Jens Holdenried, Ditzingen (DE); Rainer Stauch, Weil der Stadt (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 163 days.

(21) Appl. No.: 14/430,637

(22) PCT Filed: Sep. 3, 2013

(86) PCT No.: PCT/EP2013/068192
§ 371 (c)(1),
(2) Date: Mar. 24, 2015

(87) PCT Pub. No.: WO2014/048688
PCT Pub. Date: Apr. 3, 2014

(65) Prior Publication Data

US 2015/0247680 A1 Sep. 3, 2015

(30) Foreign Application Priority Data

Sep. 25, 2012 (DE) ..... 10 2012 217 333

(51) Int. Cl.
*F28F 1/42* (2006.01)
*F28F 13/12* (2006.01)
(Continued)

(52) U.S. Cl.
CPC ..... *F28F 1/04* (2013.01); *F28F 1/02* (2013.01); *F28F 1/06* (2013.01); *F28F 1/40* (2013.01);
(Continued)

(58) Field of Classification Search
CPC ..... F28F 2001/027
(Continued)

(56) References Cited

U.S. PATENT DOCUMENTS 6,209,629 B1 * 4/2001 Halt ..... F28F 3/044 165/177
6,286,201 B1 9/2001 Prater et al.
(Continued)

FOREIGN PATENT DOCUMENTS

DE 25 39 971 A1 3/1977
DE 10 2004 045 923 A1 5/2005
(Continued)

OTHER PUBLICATIONS

International Search Report, PCT/EP2013/068192, dated Oct. 10, 2013, 3 pgs.
(Continued)

*Primary Examiner* — Leonard R Leo
(74) *Attorney, Agent, or Firm* — Paul D. Strain, Esq.; Strain & Strain PLLC

(57) ABSTRACT

The invention relates to a flat pipe, comprising two substantially flat first walls that are opposite each other and arranged parallel to each other, two arcuate second walls that connect the two flat first walls, and an interior through which a medium can flow, wherein projections that protrude into the interior are provided in at least one of the flat first walls, wherein projections that protrude into the interior are provided in the arcuate second walls.

14 Claims, 3 Drawing Sheets

(51) Int. Cl.

| | |
|---|---|
| ***F28F 1/04*** | (2006.01) |
| ***F28F 3/04*** | (2006.01) |
| ***F28F 1/02*** | (2006.01) |
| ***F28F 1/06*** | (2006.01) |
| ***F28F 1/40*** | (2006.01) |

(52) U.S. Cl.
CPC ..... *F28F 3/044* (2013.01); *F28F 2001/027* (2013.01)

(58) Field of Classification Search
USPC ..... 165/177, 179, 109.1, 153
See application file for complete search history.

(56) References Cited

U.S. PATENT DOCUMENTS

| | | | | |
|---|---|---|---|---|
| 6,698,509 | B2 * | 3/2004 | Rong | F28F 9/0214 165/153 |
| 6,938,685 | B2 * | 9/2005 | Duerr | F28F 3/04 165/179 |
| 7,934,541 | B2 * | 5/2011 | Park | F28D 1/0341 165/153 |
| 8,267,163 | B2 * | 9/2012 | Stewart | F28F 1/40 165/177 |
| 2005/0081379 | A1 | 4/2005 | Askani et al. | |
| 2005/0161208 | A1 | 7/2005 | Sucke et al. | |
| 2006/0201665 | A1 | 9/2006 | Yu et al. | |
| 2007/0107882 | A1 * | 5/2007 | Geskes | F28F 1/40 165/109.1 |
| 2009/0188655 | A1 | 7/2009 | Agee | |

FOREIGN PATENT DOCUMENTS

| | | | |
|---|---|---|---|
| DE | 10 2010 005 269 | A1 | 7/2011 |
| EP | 0 874 210 | A2 | 10/1998 |
| EP | 1 256 772 | A2 | 11/2002 |
| EP | 2 199 722 | A2 | 6/2010 |
| EP | 2 372 286 | A2 | 10/2011 |

OTHER PUBLICATIONS

German Search Report, Appl. No. 10 2012 217 333.1, dated Aug. 9, 2013, 5 pgs.

* cited by examiner

FLAT PIPE

CROSS-REFERENCE TO RELATED PATENT APPLICATIONS

This application is a National Stage of International Application No. PCT/EP2013/068192, filed Sep. 3, 2013, which is based upon and claims the benefit of priority from prior German Patent Application No. 10 2012 217 333.1, filed Sep. 25, 2012, the entire contents of all of which are incorporated herein by reference in their entirety.

TECHNICAL FIELD

The invention relates to a flat tube having two opposing, substantially flat first walls arranged parallel to one another, and two curved second walls connecting the two flat first walls, with an interior space through which a medium can flow, wherein projections protruding into the interior space are provided in at least one of the flat first walls. The invention also relates to a heat exchanger having such flat tubes.

STATE OF THE ART

In the state of the art flat tubes have become known as so-called rectangular tubes, which comprise two flat, broad side walls, which are connected by flat side walls. The corners between the flat, broad walls and the flat lateral walls are here provided with a small radius. These flat tubes are of substantially rectangular design and are used for various types of heat exchangers.

For use in exhaust gas recirculation coolers these rectangular tubes are provided with projections protruding into the interior space, in order to improve the heat transfer between the exhaust gas flowing through and the wall. The projections are also referred to as so-called winglets. Outwardly protruding projections are also used as spacers between adjacent flat tubes, see also DE 10 2004 045 923 A1.

So-called rounded flat tubes, which have two flat, broad side walls, which are connected by curved side walls, are also disclosed in the state of the art. These flat tubes are of substantially rectangular design with convex side walls and are likewise used for various types of heat exchangers.

For use in exhaust gas recirculation coolers these rounded flat tubes are province, in the flat, broad side walls, with projections protruding into the interior space, in order to improve the heat transfer between the exhaust gas flowing through and the wall. Since in these flat tubes the width of the flat side wall is reduced compared to the rectangular tubes, however, because the lateral curve takes up more overall space than does the flat side wall in a rectangular tube, the impressed projections are arranged more thinly and the projections cannot protrude into the areas of the rounded corners. This results in a reduced heat transfer the rounded flat tube compared to the rectangular tube. Comparative measurements show reductions by as much as 10%.

The rounded flat tubes nevertheless have the advantage that under alternating thermal loads they show a significantly longer service life than comparable rectangular tubes, since the rounded corners have a greater strength than the flat side walls of the rectangular tubes.

DESCRIPTION OF THE INVENTION, OBJECT, SOLUTION, ADVANTAGES

The object of the present invention, therefore, is to create a rounded flat tube which affords a performance density at least equal to a comparable rectangular tube and at the same time retains the greater thermal shock resistance. The object is furthermore to create a heat exchanger having such flat tubes.

The object of the present invention with regard to the flat tube is achieved by a flat tube having the features of the embodiments of the application.

An exemplary embodiment of the invention relates to a flat tube having two opposing substantially flat first walls arranged parallel to one another, and two curved second walls connecting the two flat first walls, with an interior space through which a medium can flow, wherein projections protruding into the interior space are provided in at least one of the flat first walls, wherein projections protruding into the interior space are provided in the curved second walls. This gives the rounded flat tube with its high thermal shock resistance a greater performance density, because projections protruding into the interior space are now also provided in the area of the rounded corners. This reduces the areas of the interior space in which the flow is not swirled by projections.

It is advantageous here if both of the opposing, flat first walls each have projections protruding into the interior space. This leads to an increased performance density.

It is particularly advantageous if both of the opposing, curved second walls have projections protruding into the interior space. The performance density is thereby increased because salient projections are now provided at both rounded end-faces.

It is also useful for at least one, preferably both of the two opposing, flat first walls to have outward-facing projections. Knobs serving as spacers are thereby created between adjacent flat tubes, so that the spacing of the tubes is defined and the flat tubes are able to touch one another only in small areas.

It is also useful for the inward-facing projections of the flat first walls to be arranged with a first repeat rate along the longitudinal axis of the flat tube. This facilitates production, because the projections can be periodically impressed by means of roller stamping dies or correspondingly repetitive stamping tools.

It is also advantageous for the inward-facing projections of the curved second walls to be arranged with a second repeat rate along the longitudinal axis of the flat tube. Again the projections can thereby be produced by simplified tool design to repeat periodically.

It is useful here for one repeat rate to be a whole-number multiple, including 1, of the other repeat rate. This limits the total periodic length, which in turn facilitates a variation in tube length, and reduces the outlay for periodically repeating tools.

It is particularly useful if the second repeat rate s twice the first repeat rate. With this relative combination it would be possible, with rounded, flat tubes affording the same pressure gradient, to achieve the same performance densities as with a comparable rectangular tube.

It is also useful for the projections of the flat first walls protruding into the interior space to be arranged in an x-shape and/or o-shape. An optimized flow can thereby be achieved.

It is particularly advantageous for the outwardly protruding projections of the flat walls to be arranged between the projections of the first wall arranged in an o-shape and protruding into the interior space.

It is furthermore useful for the projections of opposing first walls protruding into the interior space to be arranged so as to complement one another, so that an x-shaped arrangement in a first wall is situated opposite an o-shaped arrangement of an opposing first wall. An improved swirl formation is thereby obtained.

It is also useful for the projections provided in the curved second walls and protruding into the interior space to have an oval cross section.

It is also advantageous for a projection in the curved second wall to be arranged substantially on a level with the center of a projection in the flat first wall. This creates a favorable tube design, because the tube constrictions produced by the projections are not arranged at the same level, which limits the increase in the pressure gradient.

It is also useful for at least one end area or preferably both end areas of the flat tube to be formed without projections. This improves the boiling prevention in the tube of the heat exchanger. It is useful here for the end areas to have a length of approximately 5 mm to 50 mm, allowing these end areas to be of different length for the various projections. 15 mm are preferably produced without any type of projections and a further 30 mm without outward projections.

It is also advantageous here for at least one end area or preferably both end areas of the flat tube to be formed without projections. This is particularly advantageous because winglets, knobs and depressions need not begin and/or end at the same longitudinal coordinate of the tube.

The object of the present invention with regard to the heat exchanger is achieved by a heat exchanger having the features of the embodiments of the application.

Advantageous developments of the present invention are described in the dependent claims and in the following description of the figures.

BRIEF DESCRIPTION OF THE DRAWINGS

The invention is explained in detail below on the basis of an exemplary embodiment, referring to a drawing, in which.

PREFERRED EMBODIMENT OF THE INVENTION

Figures 1A, 1B, 1C:
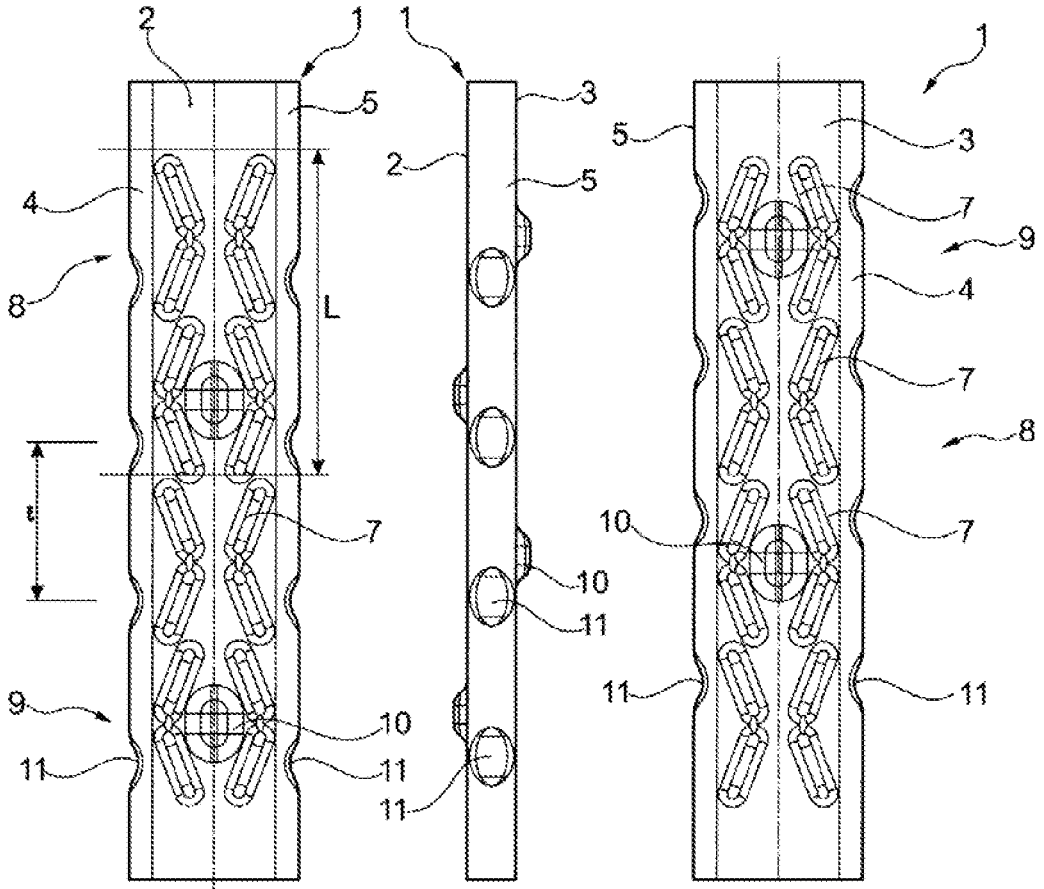
FIG. 1*a* shows a schematic view of a flat tube viewed from above.
FIG. 1*b* shows a schematic view of a flat tube viewed from the side.
FIG. 1*c* shows a schematic view of a flat tube viewed from below.
Figure 1D:
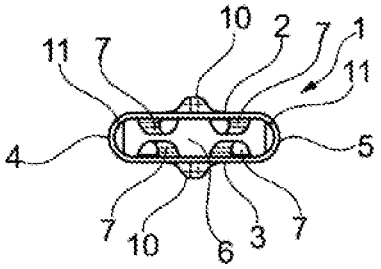
FIG. 1*d* shows a schematic view of a flat tube viewed from the front.
Figure 1E:
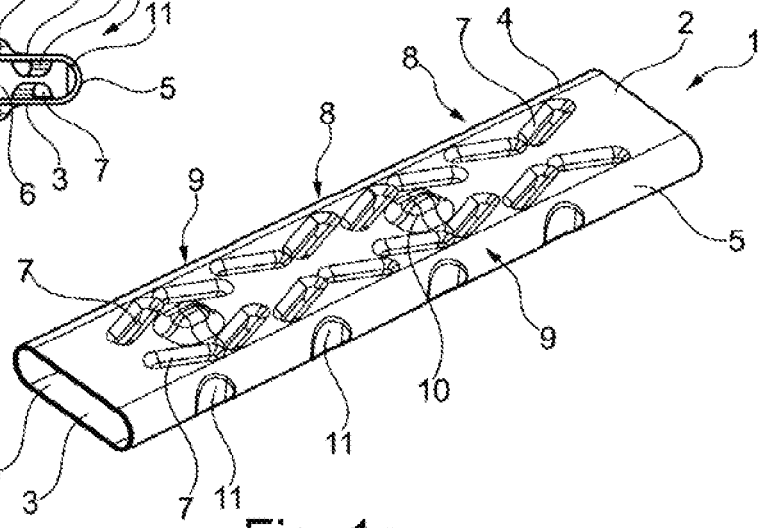
FIG. 1*e* shows a schematic, perspective view of a flat tube.

FIGS. 1*a* to 1*e* show an exemplary embodiment of a rounded flat tube 1, which has two opposing, flat first walls 2, 3. The two flat first walls 2, 3 are of substantially flat design and are arranged parallel to one another. The flat first walls 2, 3 are connected to one another by means of curved second walls 4, 5 on the longitudinal side of the flat first walls 2, 3. Here the curved second walls 4, 5 are of semicircular or otherwise curved design.

Between the substantially flat first walls 2, 3 and the curved second walls 4, 5 the flat tube defines an interior space 6 allowing a medium to flow through the flat tube. The medium is preferably exhaust gas or an exhaust gas-air mixture. Toe flat tube is advantageously used as a tube of a exhaust gas recirculation cooler or a charge-air intercooler.

As can be seen, projections 7, which protrude into the interior space 6 of the flat tube 1, where they are intended to achieve a swirling of the medium flowing through the flat tube 1, are impressed in the flat first walls 2, 3.

Here the projections 7 are impressed into the flat first wall 2, 3 as elongated projections 7. As can be seen from FIGS. 1*a* to 1*e*, the projections 7 are arranged impressed into the opposing walls 2, 3 in an x-shape and an o-shape, the x-shaped impressions 8 alternating with the o-shaped impressions 9 viewed in the longitudinal direction of the flat tube 1.

An o-shaped arrangement of the projections here means that four of the projections are arranged in a diamond pattern, so that they form an O, as it were. An x-shaped arrangement of the projections here means that four of the projections are arranged in an x or star shape, so that they form an X, as it were.

Outward-facing projections 10, which may serve as spacers for adjacent flat tubes 1, are furthermore provided in the walls 2, 3, the outwardly protruding projections 10 being arranged in the area of the projections arranged in an o-shape. The projections are arranged in the center of four projections 7 arranged in an o-shape.

Compared to FIGS. 1*a* and 1*c* it can be seen that the arrangement of the projections 7 on one wall 2 is staggered in comparison to the arrangement of the projections 7 on the opposing wall 3. Thus in the case of an x-shaped arrangement 8 of the projections 7 on the wall 2 there is an o-shaped arrangement 9 of the projections 7 on the wall 3 opposite, and vice versa. The arrangement of the outwardly protruding projections 10 is also staggered between opposing first walls 2, 3.

It can also be seen that projections 11, which protrude from the curved second wall 4, 5 into the interior space 6 of the flat tube 1, are provided in the curved second wall 4, 5.

The periodic repetition of the projections of repeat length L is drawn in in the exemplary embodiment in FIGS. 1*a* to 1*e*, the periodic repetition of the projections being denoted by the repeat length I. Here the repeat length is the length after which the same pattern reoccurs. The repeat length i in FIGS. 1*a* to 1*e* is half the repeat length L, so that the repeat rate of the projections 11 is twice the repeat rate of the projections 7.

It can be seen from FIGS. 1*a* to 1*e* that the projections 11 are arranged opposite in the two curved second walls 4, 5. Alternatively the projections 11 in one curved wall 4 may also be staggered in relation to the projections 11 in the opposing wall 5.

Figure 2A:
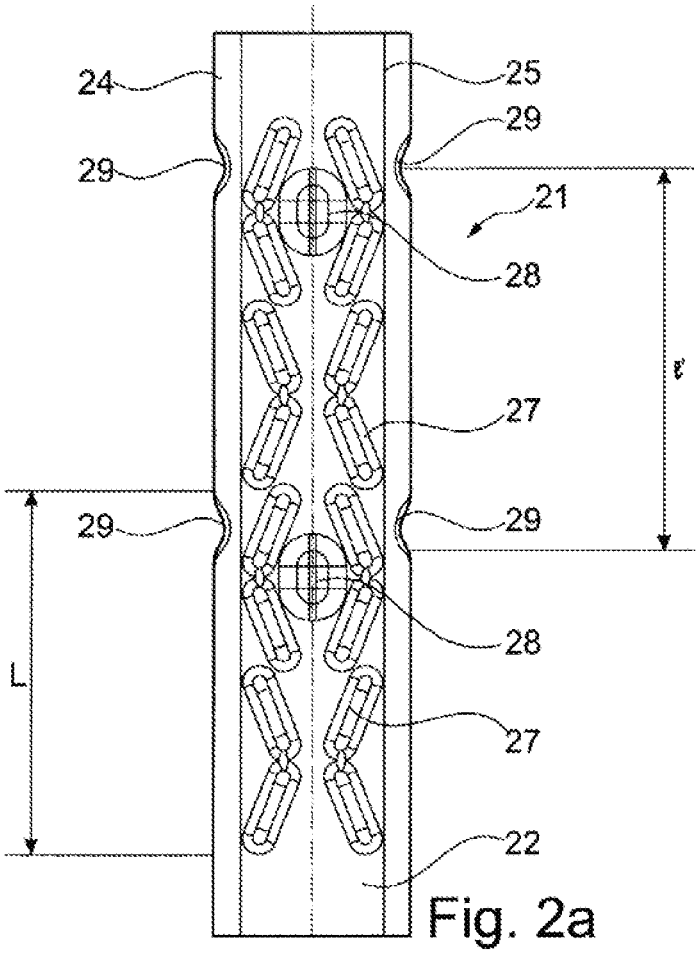
FIG. 2*a* shows a schematic view of a flat tube viewed from above.
Figure 2B:
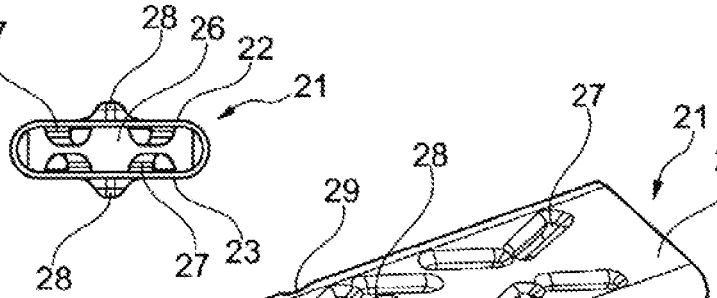
FIG. 2*b* shows a schematic view of a flat tube viewed from the front.
Figure 2C:
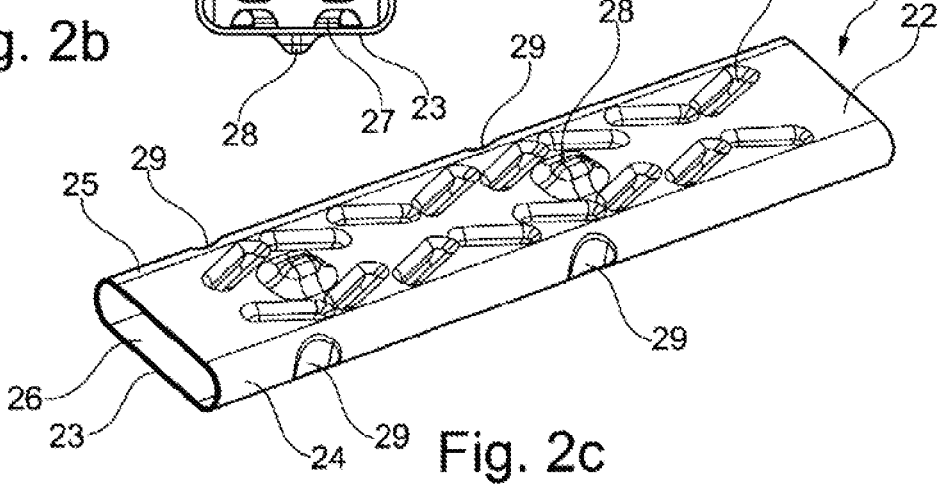
FIG. 2*c* shows a schematic, perspective view of a flat tube.

FIGS. 2*a* to 2*c* show a further exemplary embodiment of a flat tube 21 according to the invention, which like the exemplary embodiment in FIGS. 1*a* to 1*e* has substantially flat first walls 22, 23, which are situated opposite one another and are arranged parallel to one another. The first wall 22, 23 are connected to one another by second curved walls 24, 25. Here projections, such as impressions 27, 28, which protrude from the first walls 22, 23, are provided in the flat first walls. Here the projections 27 protrude into the interior space 26 and the projections 28 protrude outwards.

Projections 29, which protrude into the interior space 26, are likewise provided in the curved second walls 24, 25. The arrangement of the projections 27, 28 corresponding substantially to the arrangement of the projections 7, 10 in FIGS. 1*a* to 1*e*, the arrangement of the projections 29 corresponding substantially to the arrangement of the projections 11 in FIGS. 1*a* to 1*e*. The difference between the exemplary embodiment in FIGS. 2*a* to 2*c* and the exemplary embodiment in FIGS. 1*a* to 1*e* is that the repeat length L' in the exemplary embodiment in FIGS. 2*a* to 2*c* corresponds to the repeat length L of the projections 27.

Figure 3A:
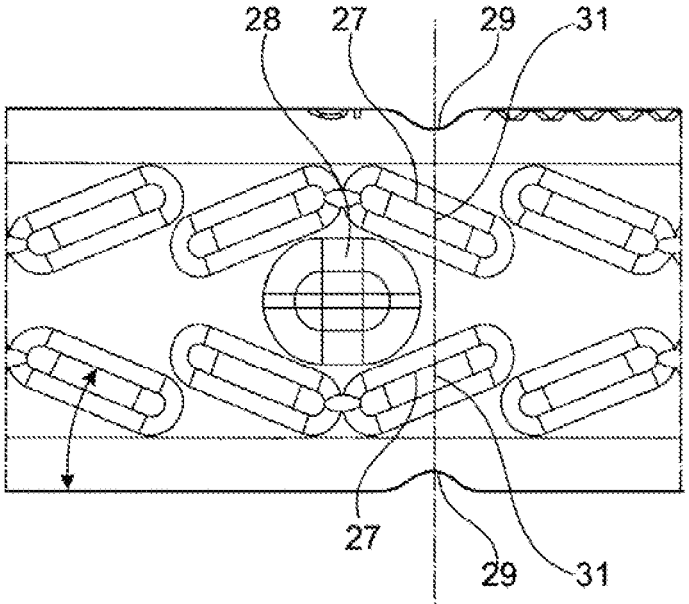
FIG. 3*a* shows a schematic view of a detail of a flat tube viewed from above.
Figure 3B:
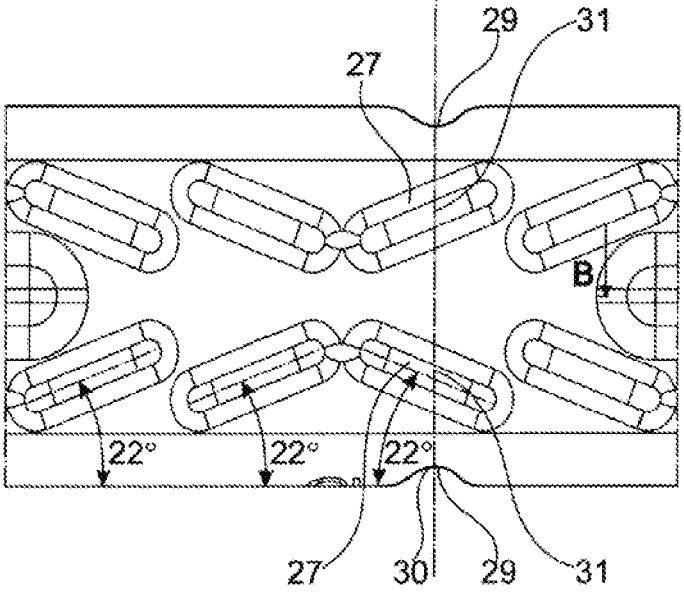
FIG. 3*b* shows a schematic view of a detail of a flat tube viewed from below.

FIGS. 3*a* and 3*b* show the arrangement of a projection 29 in relation to the arrangement of the projections 27. It can be seen here that the center 30 of the projection 29 is approximately on the same level as the center 31 of a projection 27. The projection 29 is therefore centered on a projection 27, which is arranged in an o-shape with a group of projections 27, a projection 28 being arranged at the center of the o-shaped arrangement.

Figure 3C:
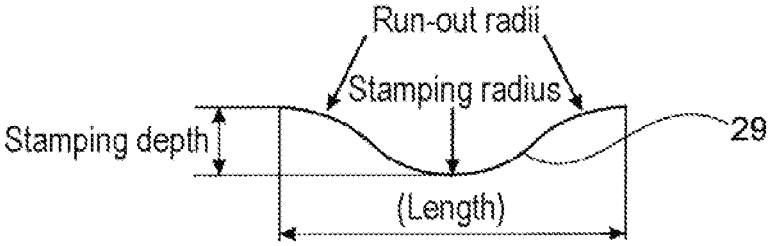
FIG. 3*c* shows a schematic view of a projection in a curved wall.

FIG. 3*c* shows the extent of a projection 29 by way of example, the extent transversely to the longitudinal direction of the flat tube, the stamping depth, being approximately 1.0 mm and the stamping radii and the run-out radii each being approximately 6.0 mm. The stamping depth of the projections 29 may suitably be selected in the range between 0.5 mm and 1.2 mm, in order for them to protrude sufficiently far into the interior space in relation to the curved second wall. Here the impression is formed by a central stamping radius having two edge run-out radii. The length, transversely to the stamping depth, may here advantageously be the multiple of the stamping depth.

It can seen from FIGS. 3*b* and 3*a* that the projections 27 are arranged at an angle of approximately 22° to the longitudinal axis of the tube, the projections 28 being of circular or oval design, the longitudinal axis in the case of an oval stamping being arranged parallel to the longitudinal axis of the tube.

The invention claimed is:

1. A flat tube having two opposing, substantially flat first walls arranged parallel to one another, two curved second walls connecting the two flat first walls, an interior space bounded by the substantially flat first walls and the curved second walls through which a medium can flow, a first plurality of projections arranged on the substantially flat first walls protruding into the interior space, a second plurality of projections arranged on the curved walls protruding into the interior space, and a third plurality of projections arranged on the substantially flat first walls protruding outwardly and away from the interior space, wherein the projections of the first plurality of projections are each elongated having a greater length than width and are each arranged in a repeating pattern alternating between an x-shape and an o-shape such that each projection of the first plurality of projections forms part of an x-shape or part of an o-shape, wherein the x-shape and the o-shape each consist of four distinct projections, wherein each x-shape in the repeating pattern is adjacent to an o-shape and each o-shape in the repeating pattern is adjacent to an x-shape, wherein the flat tube does not have any projections other than the first plurality of projections, the second plurality of projections, and the third plurality of projections.

2. The flat tubes as claimed in claim 1, wherein the projections from the first plurality of projections are arranged with a first repeat rate along the longitudinal axis of the flat tube.

3. The flat tubes as claimed in claim 2, wherein the projections from the second plurality of projections are arranged with a second repeat rate along the longitudinal axis of the flat tube.

4. The flat tube as claimed in claim 3, wherein the first repeat rate substantially corresponds to a whole-number multiple of the second repeat rate greater than one.

5. The flat tube as claimed in claim 3, wherein the second repeat rate is twice the first repeat rate.

6. The flat tube as claimed in claim 1, wherein the outwardly protruding projections from the third plurality of projections are in every instance arranged inside the o-shape.

7. The flat tube as claimed in claim 1, wherein the projections from the first plurality of projections are arranged so as to complement one another, so that an x-shaped arrangement in a first wall of the substantially flat first walls is situated opposite an o-shaped arrangement of an opposing second wall of the substantially flat first walls.

8. The flat tube as claimed in claim 1, wherein the projections from the second plurality of projections have an oval cross section with respect to a surface of the curved second walls.

9. The flat tube as claimed in claim 1, wherein a center of a projection from the second plurality of is substantially aligned with a center of a projection from the first plurality of projections.

10. The flat tube as claimed in claim 1, wherein at least one end area of the flat tube is formed without projections.

11. The flat tube as claimed in claim 10, wherein recessed end areas for the respective projections deviate from one another.

12. The flat tube as claimed in claim 1, wherein there are no projections arranged between the x-shape and the o-shape in the repeating pattern.

13. A heat exchanger, wherein the heat exchanger comprises a plurality of flat tubes, wherein the each of the flat tubes of the plurality of flat tubes is a flat tube having (i) two opposing, substantially flat first walls arranged parallel to one another, two curved second walls connecting the two flat first walls, and (ii) an interior space bounded by the substantially flat first walls and the curved second walls through which a medium can flow, a first plurality of projections arranged on the substantially flat first walls protruding into the interior space, a second plurality of projections arranged on the curved walls protruding into the interior space, and a third plurality of projections arranged on the substantially flat first walls protruding outwardly and away from the interior space;

wherein the projections from the first plurality of projections are elongated having a greater length than width and are each arranged in a repeating pattern alternating between an x-shape and an o-shape such that each projection of the first plurality of projections forms part of an x-shape or part of an o-shape, wherein the x-shape and the o-shape each consist of four distinct projections, wherein each x-shape in the repeating pattern is adjacent to an o-shape and each o-shape in the repeating pattern is adjacent to an x-shape.

14. A flat tube having two opposing, substantially flat first walls arranged parallel to one another, two curved second walls connecting the two flat first walls, an interior space bounded by the substantially flat first walls and the curved second walls through which a medium can flow, a first plurality of projections arranged on the substantially flat first walls projecting into the interior space, a second plurality of projections arranged on the curved walls protruding into the interior space, and a third plurality of projections arranged on the substantially flat first walls protruding outwardly and away from the interior space, wherein both of the opposing, flat first walls each have projections from the first plurality of projections protruding into the interior space, wherein both of the opposing, curved second walls have projections from the second plurality of projections protruding into the interior space, wherein both of the two opposing, substantially flat first walls have outward-facing projections from the third plurality of projections, wherein the projections from the first plurality of projections are elongated having a greater length than width and are each arranged in a repeating pattern alternating between an x-shape and an o-shape such that each projection of the first plurality of projections forms part of an x-shape or part of an o-shape, wherein each x-shape in the repeating pattern is adjacent to an o-shape and each o-shape in the repeating pattern is adjacent to an x-shape, wherein there are no projections arranged between the x-shape and the o-shape in the repeating pattern, wherein the x-shape and o-shape each consist of four distinct projections, wherein the outwardly protruding projections from the third plurality of projections are arranged inside the o-shape in every instance, wherein the projections from the first plurality of projections are arranged so as to complement one another, so that an x-shaped arrangement in a first wall of the substantially flat first walls is situated opposite an o-shaped arrangement of an opposing second first wall of the substantially flat first walls, wherein the projections from the second plurality of projections have an oval cross section with respect to a surface of the curved second walls, wherein a center of a projection from the second plurality of projections is substantially aligned with a center of a projection from the first plurality of projections, wherein the flat tube does not have any projections other than the first plurality of projections, the second plurality of projections, and the third plurality of projections.

* * * * *